US006923265B2

(12) United States Patent
Mehr

(10) Patent No.: US 6,923,265 B2
(45) Date of Patent: Aug. 2, 2005

(54) SUBMERGED THERMALLY SENSITIVE ELEMENT FOR AN AUTOMATIC FIRE SPRINKLER

(76) Inventor: Ralph R. Mehr, PO Box 21666, Tel Aviv 61216 (IL)

( * ) Notice: Subject to any disclaimer, the term of this patent is extended or adjusted under 35 U.S.C. 154(b) by 0 days.

(21) Appl. No.: 10/752,025

(22) Filed: Jan. 7, 2004

(65) Prior Publication Data

US 2005/0145395 A1 Jul. 7, 2005

(51) Int. Cl.[7] ..... A62C 2/00; A62C 3/00; A62C 37/12; A62C 37/08; A62C 37/36

(52) U.S. Cl. ..... 169/46; 169/57; 169/37; 169/38; 169/41; 169/42

(58) Field of Search ..... 169/46, 57, 37, 169/38, 41, 42, 16, 56; 239/288, 75

(56) References Cited

U.S. PATENT DOCUMENTS 4,014,388 A * 3/1977 Anderson ..... 169/37
4,066,129 A * 1/1978 Anderson ..... 169/37
4,108,247 A * 8/1978 Mohler ..... 169/38
4,706,759 A * 11/1987 Grasseschi ..... 169/51
5,020,601 A * 6/1991 Retzloff et al. ..... 169/37
5,080,176 A * 1/1992 Polan et al. ..... 169/37
6,082,463 A * 7/2000 Ponte ..... 169/41
6,484,809 B1 * 11/2002 Elder ..... 169/37

* cited by examiner

*Primary Examiner*—David A. Scherbel
*Assistant Examiner*—Darren Gorman
(74) *Attorney, Agent, or Firm*—Mark M. Friedman

(57) ABSTRACT

An automatic fire sprinkler device for fluidly connecting to a water system of a fire sprinkler, including: (a) a housing having an inlet for fluidly connecting with the water system, and an outlet for fluidly connecting with a discharge unit having a deflector for dispersing water within a water coverage area; (b) a plug, operatively associated with the housing, having a stand-by position and an activated position, such that in the stand-by position, the plug is positioned to obstruct a flow of the water from the water system, and such that in the activated position, the plug is positioned to allow the water to flow from the water system to the discharge unit, and (c) a submerged thermally sensitive element, responsive to a pre-determined temperature and operatively connected to the plug, for triggering the plug into the activated position when a temperature of an environment reaches the pre-determined temperature, so as to allow the water flow.

18 Claims, 4 Drawing Sheets

100
10
12
14
16
18
20
22
24
26
28
A
B
C
I-I

Fig 2a
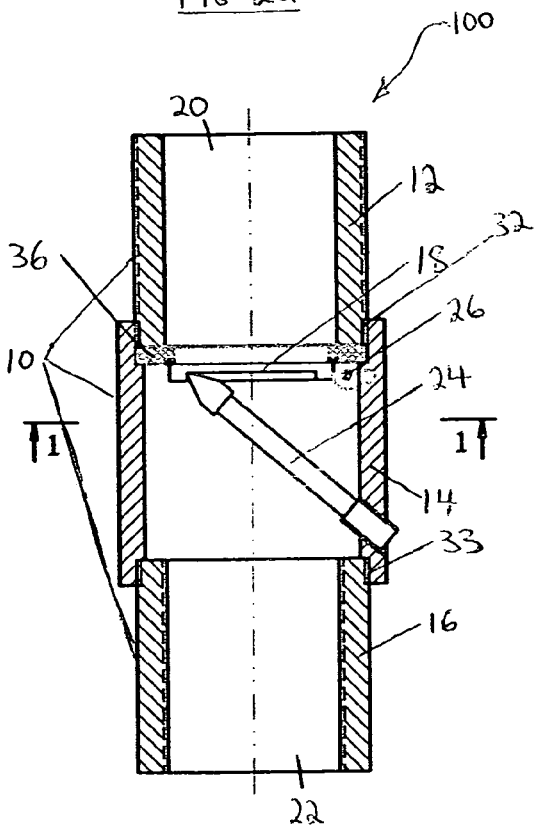
Fig. 2b
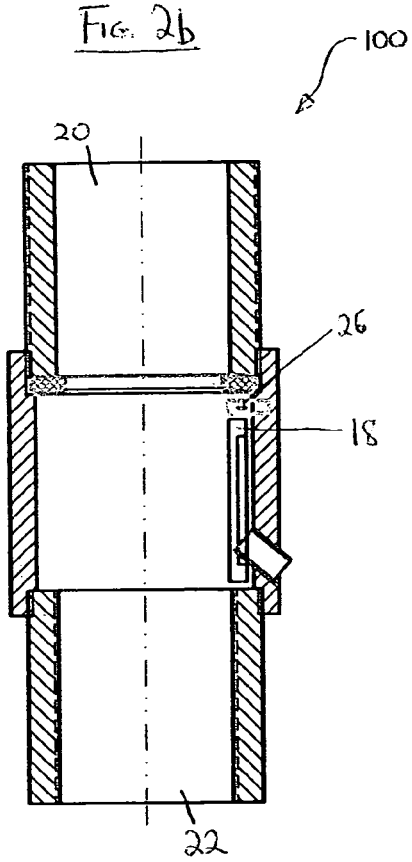
1–1
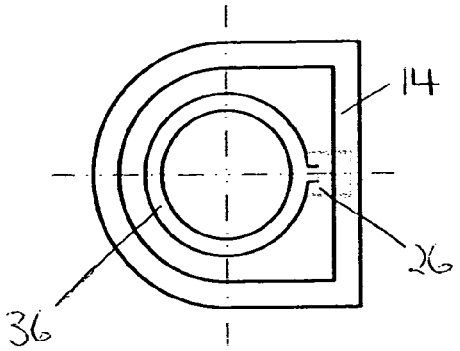
Fig. 2c

SUBMERGED THERMALLY SENSITIVE ELEMENT FOR AN AUTOMATIC FIRE SPRINKLER

FIELD AND BACKGROUND OF THE INVENTION

The present invention relates to automatic fire sprinklers, and more particularly, to an automatic fire sprinkler having a safety mechanism for preventing accidental or malicious activation of the sprinkler, and averting the water damages associated therewith.

An automatic fire sprinkler typically includes a body having a base, an inlet connected to a source of pressurized water (or fire-retardant fluid), and an outlet, both defined by the base, a passageway between the inlet and outlet, and a flow-adjusting orifice, usually located upstream close to the outlet. Additionally, a plug closing the outlet when the sprinkler is in standby condition is held in place by a thermally sensitive element (also known as a fuse). When the temperature is elevated to a pre-determined value, the thermally sensitive element disintegrates. Consequently, the water pressure urges the plug away from the outlet, enabling the sprinkler to discharge. A supported deflector, integrally connected to the body, distributes the water stream flowing from the outlet, so as to disperse the stream over the region to be protected by the sprinkler.

Generally, the thermally sensitive element is a special glass tube containing an expansive liquid, such that at a pre-determined elevated temperature, the glass is broken by the pressure of the expansive liquor. Alternatively, the thermally sensitive element is fabricated from soft metal solder, which softens or melts at the pre-determined temperature, thus permitting the sprinkler to discharge. As a result of these weak materials of construction, the thermally sensitive elements are vulnerable and may easily be accidentally damaged and activated. Accidental activation of fire sprinklers in fire-protected areas may occur during various operations normally carried in these areas, such as forklifts maneuvering within covered storage areas, stacking of goods in proximity to the sprinkler-bearing ceiling, etc.

Malicious activation of fire sprinklers is sometimes effected by hostile individuals, such as angry workers, hooligans or vandals, who seek out ways to cause damage. Occasionally, the fire-protected areas are situated within inherently violent and/or delinquent environments such as prisons, detention centers or correctional institutions, in which tampering is not an exceptional phenomenon.

The activation of fire sprinklers over the protected area causes severe water damage. Many kinds of stored merchandise are water sensitive, e.g. electronic equipment, books, etc. In some cases, the damage to stored materials may even be irreparable, as in the case of archives or museums.

The various requirements for automatic fire sprinklers are defined in the National Fire Protection Association (NFPA) 13 Standard for the Installation of Sprinkler Systems, which was also adopted by the American National Standards Institute (ANSI). Among these requirements, the NFPA 13 standard also includes the specific requirements for the various thermally sensitive elements, but there are no obligatory requirements concerning means for preventing accidental or malicious activation. Even so, there exist several prior art sprinklers having mechanisms for reducing the probability of accidental or malicious activation.

Most fire sprinkling systems belong to a type known in the art as the Wet-pipe system. This type of system is the easiest to design and install, and the simplest to maintain. Wet-pipe systems contain water under pressure at all times and utilize a series of closed sprinklers. When a fire occurs and produces a sufficient amount of heat to activate one or more sprinkler, because an automatic water supply is mandated, water immediately discharges from the open sprinklers. Wet-pipe systems are inherently reliable and relatively inexpensive to maintain.

However, a fire sprinkler for use in a Wet-pipe system is very vulnerable. The thermally sensitive element, which is exposed and mechanically-weak, can easily be tampered with or accidentally broken, such that the fire sprinkler is activated, causing water damage to the goods in the protected area.

One known system for overcoming this problem is the Pre-action system. In Pre-action systems, which are mentioned in the NFPA 13 standard, the piping is charged with air under pressure rather than water, while the water supply is held back by means of a pre-action valve.

The system is equipped with a supplemental detection system such as smoke detectors or heat sensitive detectors, which control the pre-action valve. Operation of the detection system allows the pre-action valve to automatically open and admit water into the piping network. Water will discharge from the system only if a fire has generated a sufficient quantity of heat to cause operation of one or more sprinklers. In essence, the system acts appears as a Wet-pipe system once the pre-action valve operates.

Because water is held back with a pre-action valve, water does not flow into the system until the supplemental fire detection system is activated, and the pre-action valve receives a signal to open. The pre-action valve remains in a closed position until the detection system is activated.

A variation of the standard or single-interlock Pre-action system is the double-interlock Pre-action system. In the double interlock system, water enters the system piping only when both the supplemental detection system and the sprinklers on the system operate. Another variation of a Pre-action system is the non-interlock system, in which either activation of the supplemental detection system or a sprinkler initiates water flow through the system.

One of the main disadvantages of Pre-action systems is a considerably longer reaction time to a heat stimulus (i.e., a real fire) with respect to conventional Wet-pipe systems. Water begins discharging only after a pre-action main valve opens after getting at least two independent indications from the sprinklers or from one valve and one additional indicator, and after the empty piping system is completely filled. The resulting, cumulative time lag enables a fire to further develop and cause even greater fire damage. Moreover, because of the longer reaction time, the required water supply for Pre-action systems, per area of coverage area, is about 30% higher than in Wet-pipe systems.

Moreover, Wet-pipe systems, not Pre-action systems, are the preferred fire protection system for archives and the like, because of the dangerous downside of the Pre-action systems, i.e., more extensive fire damage in the event of a fire. The risk of wet documents is considered to be less problematic than documents burned beyond recognition.

Another drawback of Pre-action systems is that malicious tampering can also damage the pre-action valve so as to effect a water discharge, or alternatively, the tampering may damage any of the additional indicators, causing parts of the system to be inoperative during a real fire emergency.

It should also be noted that relative to the simple Wet-pipe systems, Pre-action systems are much more expensive and are also complicated to install and maintain.

Another known, specialized activation system utilizes Institutional sprinklers, such as Viking® Model HQR-2, manufactured by The Viking Corporation, Mich., U.S.A., or Model TFP PH5, manufactured by Tyco® Fire Products, Pennsylvania, U.S.A.

Characteristically, Institutional sprinklers are designed and installed such that most of the operating parts of the sprinkler are concealed in a metal housing inside the ceiling, except for a threaded escutcheon plate protruding from the ceiling, and tightly attached thereto. The pipe leading to the sprinkler is anchored, and a special locking prevents the removal of the threaded escutcheon plate from the ceiling.

A deflector is held by a thermally sensitive element, both of which are concealed inside the escutcheon plate of the sprinkler, until being activated by the thermally sensitive element. The thermally sensitive element, which is made of a metal solder, melts when the rated temperature is reached, releasing the linkage mechanism that holds the sprinkler closed and allowing the deflector to extend so as to discharge and distribute water.

Although systems with Institutional sprinklers provide additional protection against both accidental and malicious activation, with respect to Wet-pipe systems, Institutional sprinklers are still prone, albeit to a lesser degree, to malicious activation. Moreover, Institutional sprinklers are much more costly than their Wet-pipe system counterparts, and are designed solely for light hazard occupancy needs.

There is therefore, a recognized need for, and it would be highly advantageous to have, a device for safely and reliably preventing accidental and malicious activation of automatic fire sprinklers, a device that is efficient and inexpensive, and does not compromise the reaction time in extinguishing genuine fire hazards.

SUMMARY OF THE INVENTION

According to the teaching of the present invention there is provided an automatic fire sprinkler device having a submerged thermally sensitive element, the device for fluidly connecting to a water system of an automatic fire sprinkler, the device including: (a) a housing having an inlet for fluidly connecting with the water system, and an outlet for fluidly connecting with a discharge unit having a deflector for dispersing water within a water coverage area; (b) a plug, operatively associated with the housing, the plug having a stand-by position and an activated position, wherein the device is designed and configured such that in the stand-by position, the plug is positioned to obstruct a flow of the water from the water system, and such that in the activated position, the plug is positioned to allow the flow of water to flow from the water system to the discharge unit, and (c) a submerged thermally sensitive element, responsive to a pre-determined temperature and operatively connected to the plug, the thermally sensitive element for triggering the plug into the activated position when a temperature of an environment reaches the pre-determined temperature, so as to allow the flow of the water, and wherein the thermally sensitive element is for submerging within a ceiling in proximity to the water coverage area.

According to another aspect of the present invention there is provided a method of averting erroneous activation of an automatic fire sprinkler, the method including the steps of: (a) providing a device including: (i) a housing having an inlet for fluidly connecting with the water system, and an outlet for fluidly connecting with a discharge unit having a deflector for dispersing water within a water coverage area; (ii) a plug, operatively associated with the housing, the plug having a stand-by position and an activated position, wherein the device is designed and configured such that in stand-by position, the plug is positioned to obstruct a flow of water from the water system, and such that in activated position, the plug is positioned to allow the flow of water to flow from the water system to the discharge unit, and (iii) a submerged thermally sensitive element, responsive to a pre-determined temperature and operatively connected to the plug, and (b) submerging the thermally sensitive element within a ceiling in proximity to the water coverage area.

According to one feature in the described preferred embodiments, the automatic fire sprinkler device is structurally separate from the discharge unit.

According to another feature in the described preferred embodiments, the housing is disposed within the ceiling.

According to still another feature in the described preferred embodiments, the thermally sensitive element includes a glass component designed to disintegrate at a pre-determined temperature.

According to still another feature in the described preferred embodiments, the thermally sensitive element further includes an expansive material disposed in proximity to the glass component, the expansive material being designed to expand so as to break the glass component at a pre-determined temperature.

According to still another feature in the described preferred embodiments, the thermally sensitive element includes a metal component designed to disintegrate at a pre-determined temperature.

According to still another feature in the described preferred embodiments of the present invention, the automatic fire sprinkler device further includes a discharge unit, the discharge unit including (i) a deflector for dispersing the water within the water coverage area, and (ii) a body, operatively connected to the deflector, for allowing the flow to reach the deflector.

According to still another feature in the described preferred embodiments, the device further includes (d) a hinge mechanism, associated with the plug, for enabling the plug to move from the stand-by position to the activated position.

According to yet another feature in the described preferred embodiments, the thermally sensitive element is for directly triggering the plug.

According to still another feature in the described preferred embodiments, the thermally sensitive element is attached to the housing at a first location.

According to still another feature in the described preferred embodiments, when the temperature of the environment is below a pre-determined temperature, the thermally sensitive element is positioned to maintain the plug in the stand-by position.

According to still another feature in the described preferred embodiments of the present invention, the environment is in proximity to the water coverage area.

According to yet another feature in the described preferred embodiments, the inlet of the housing and the outlet of the housing are parts of separate housing elements.

According to still another feature in the described preferred embodiments, the submerged thermally sensitive element is disposed in an additional housing element.

According to still another feature in the described preferred embodiments of the present invention, the separate housing elements and the additional housing element have threaded ends.

According to yet another feature in the described preferred embodiments of the present invention, the automatic fire sprinkler device further includes (e) a gasket, disposed in the housing, and designed and configured to improve a sealing performance of the plug when the plug is in the stand-by position.

Finally, according to yet another feature in the described preferred embodiments, the method further includes the step of (c) triggering the plug into the activated position by the thermally sensitive element when a temperature reaches a pre-determined temperature, so as to allow the flow of the water.

The present invention successfully addresses the shortcomings of the prior art by providing an improved automatic fire sprinkler device for, and method of, safely and reliably preventing accidental and malicious activation of automatic fire sprinklers, a device that is efficient and inexpensive, and does not compromise the reaction time in extinguishing genuine fire hazards.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 2*a* is a schematic illustration of a side cross-sectional view of a submerged unit having a plug disposed in a closed position, according to another preferred embodiment of the present invention;

FIG. 2*b* is a schematic illustration of a side cross-sectional view of the submerged unit of FIG. 2*a*, with the plug disposed in an open position;

FIG. 2*c* is a top cross-sectional view of the submerged unit of FIG. 2*a;*

DESCRIPTION OF THE PREFERRED EMBODIMENTS

Figures 1A, 1B, 1C, 1D:
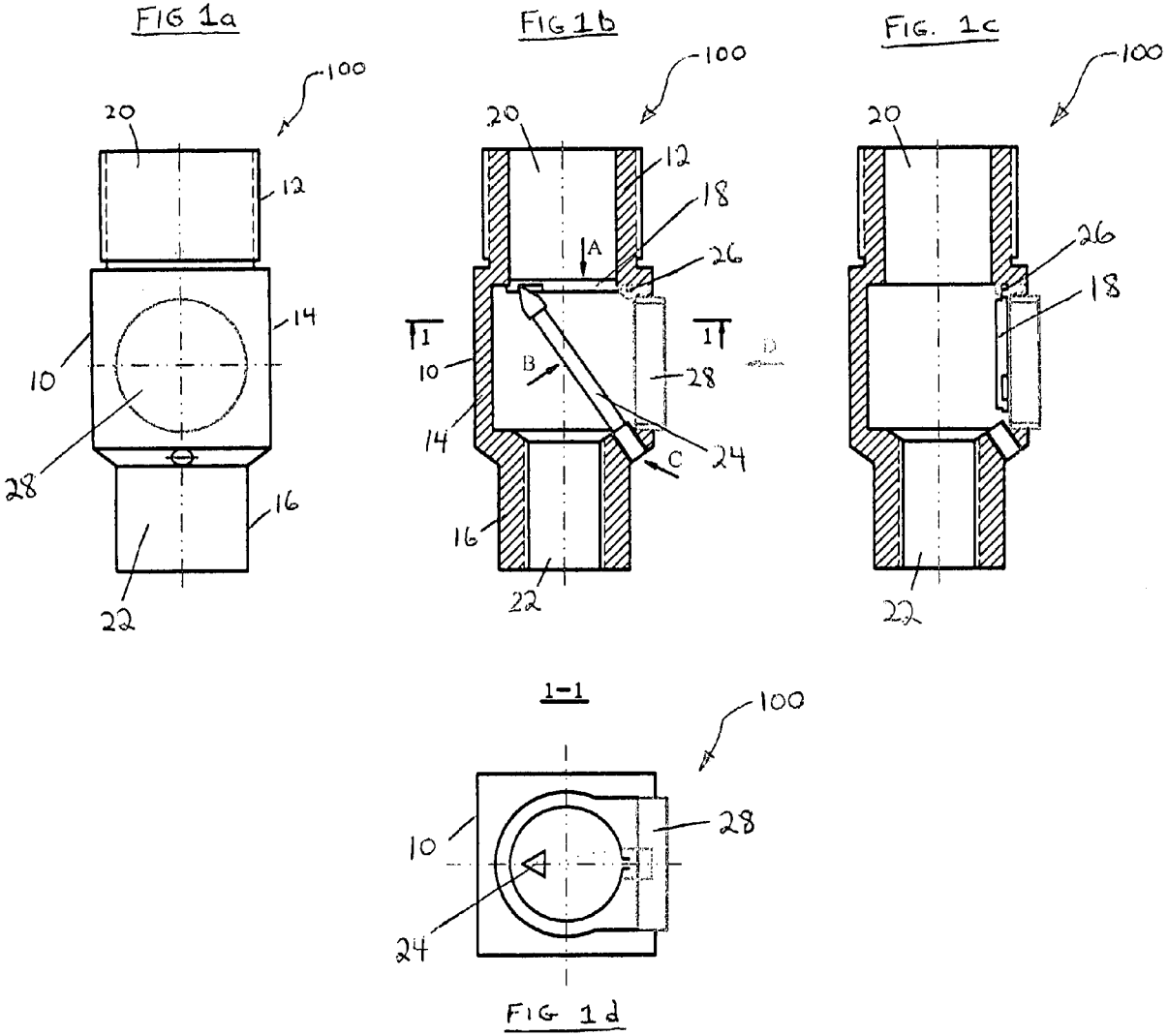
FIG. 1*a* is a schematic illustration of a front view of a submerged unit containing a thermally sensitive element, according to a preferred embodiment of the present invention.
FIG. 1*b* is a schematic illustration of a side cross-sectional view of the submerged unit of FIG. 1*a*, with the plug disposed in a closed position.
FIG. 1*c* is a schematic illustration of a side cross-sectional view of the submerged unit of FIG. 1*a*, with the plug disposed in an open position.
FIG. 1*d* is a top cross-sectional view of the submerged unit of FIG. 1*a;*

The present invention is an automatic fire sprinkler having a safety mechanism for preventing accidental or malicious activation of the sprinkler, and averting the water damages associated therewith.

The principles and operation of the system and method according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

In the automatic fire sprinkler device of the present invention, the functionality of the regular automatic fire sprinkler is separated into two distinct structural components. The outer structural component (hereinafter "outer unit" or "discharge unit"), which is disposed outside of the ceiling, includes a body with a base, an inlet connected to a source of pressurized water (or other fire-retardant fluid), and an outlet, both defined by the base, a passageway between the inlet and outlet, and a flow-adjusting orifice, usually located upstream close to the outlet. A supported deflector, attached to the body, is designed to distribute the water stream flowing from the outlet, when the sprinkler is activated, so as to disperse the stream over the coverage area of the sprinkler.

While the above-described component may be structurally similar to a simple regular sprinkler, a regular sprinkler also contains a plug for closing the outlet when the sprinkler is in a standby condition. The plug is held in place by a thermally sensitive element.

By sharp contrast, the outer unit that is used in conjunction with the present invention has no plug, and no thermally sensitive element for holding the plug in place, such that water flowing into the inlet of the outer unit passes freely through the unit and is discharged to the coverage area via the deflector. In fact, the outer unit may be any of various sprinklers that are known in the art ("open sprinklers") and do not have an installed thermally sensitive element.

The inner structural component (hereinafter also referred to as inner unit or "submerged unit"), which is completely or largely disposed within the ceiling, may include any conventional plug, which has been installed in a housing in a way that blocks the water passage and any conventional thermally sensitive element for holding the plug in place while in stand-by mode. The inner and outer structural components are operatively attached, such that the inner unit, which has the plug and sensitive element, is connected to the automatic fire sprinkler water system, while the outer unit is connected downstream to the inner unit.

Since the thermally sensitive element is installed within the ceiling, it is well-protected from both malicious activation and from accidental damage. The outer unit protrudes from the ceiling as any other Wet-pipe sprinkler. Thus, even if the outer unit is tampered with, damaged, or broken, the inner unit remains intact and functional, such that no water is released, and the merchandise or equipment in the protected area is spared from severe water damage.

Referring now to the drawings, FIGS. 1*a*–1*d* illustrate a first preferred embodiment of the inner unit, while FIGS. 2*a*–2*c* describe a second preferred embodiment. FIGS. 1*a*, 1*b*, 1*c* and 1*d* represent, respectfully, a front view, side cross-sectional views in closed and open positions, and a top cross sectional view of the first preferred embodiment. FIGS. 2*a* and 2*b* are side cross-sectional views of the second preferred embodiment in closed and open positions, and FIG. 2*c* is a top cross-sectional view of FIG. 1*a*.

In the drawings, submerged unit 100 includes a housing 10, which has a first piping section 12, a main chamber 14 and a second piping section 16. A plug 18 is disposed within housing 10, so as to completely block the flow of water from inlet 20 to outlet 22, when plug 18 is in a closed (or "stand-by") position, as shown in FIG. 1*b*. Plug 18 is held in place by a thermally sensitive element 24, attached (or touching) at one end to plug 18 and at the other edge to an inner wall of housing 10.

Referring now to FIG. 1*c*, upon reaching a rated, pre-determined temperature, as in the event of a proximal fire, thermally sensitive element 24 (shown in FIG. 1*b*) disintegrates, allowing plug 18, urged by the pressure of the water in inlet 20, to freely move around a hinge 26. Water then flows via outlet 22 and through the above-described outer unit (not shown) to extinguish the fire in the protected area.

As seen in FIG. 1*a*, housing 10 of submerged unit 100 also includes a window 28 for enabling the initial installation of element 24 within submerged unit 100, during the manufacturing process. Window 28 is also advantageously used for various maintenance purposes.

Referring now to FIGS. 2*a*–2*c*, housing 10 of submerged unit 100 is constructed of three threaded sections. A first threaded section 12 is attached to a main chamber 14 by threads 32. Main chamber 14 is also associated with a second threaded section 16 by threads 33. During the manufacturing process of unit 100, plug 18 is disposed within chamber 14 before section 12 is connected to chamber 14 and thus, opening 28 is not necessary in this embodiment.

Additionally, this embodiment preferably includes a gasket 36 made of commercially-available sealing materials, such as Teflon®, natural and synthetic rubber, etc. Gasket 36 assures complete sealing of the flow of water from inlet 20 to chamber 14.

Upon reaching a rated, pre-determined temperature, as in the event of a proximal fire, thermally sensitive element 24 (shown in FIG. 2*a*) disintegrates, allowing plug 18, urged by the pressure of the water in inlet 20, to freely move around a hinge 26. In this activated position, shown in FIG. 2*b*, water flows freely via outlet 22 and through the above-described outer unit (not shown) to extinguish the fire in the protected area.

Figure 3A:
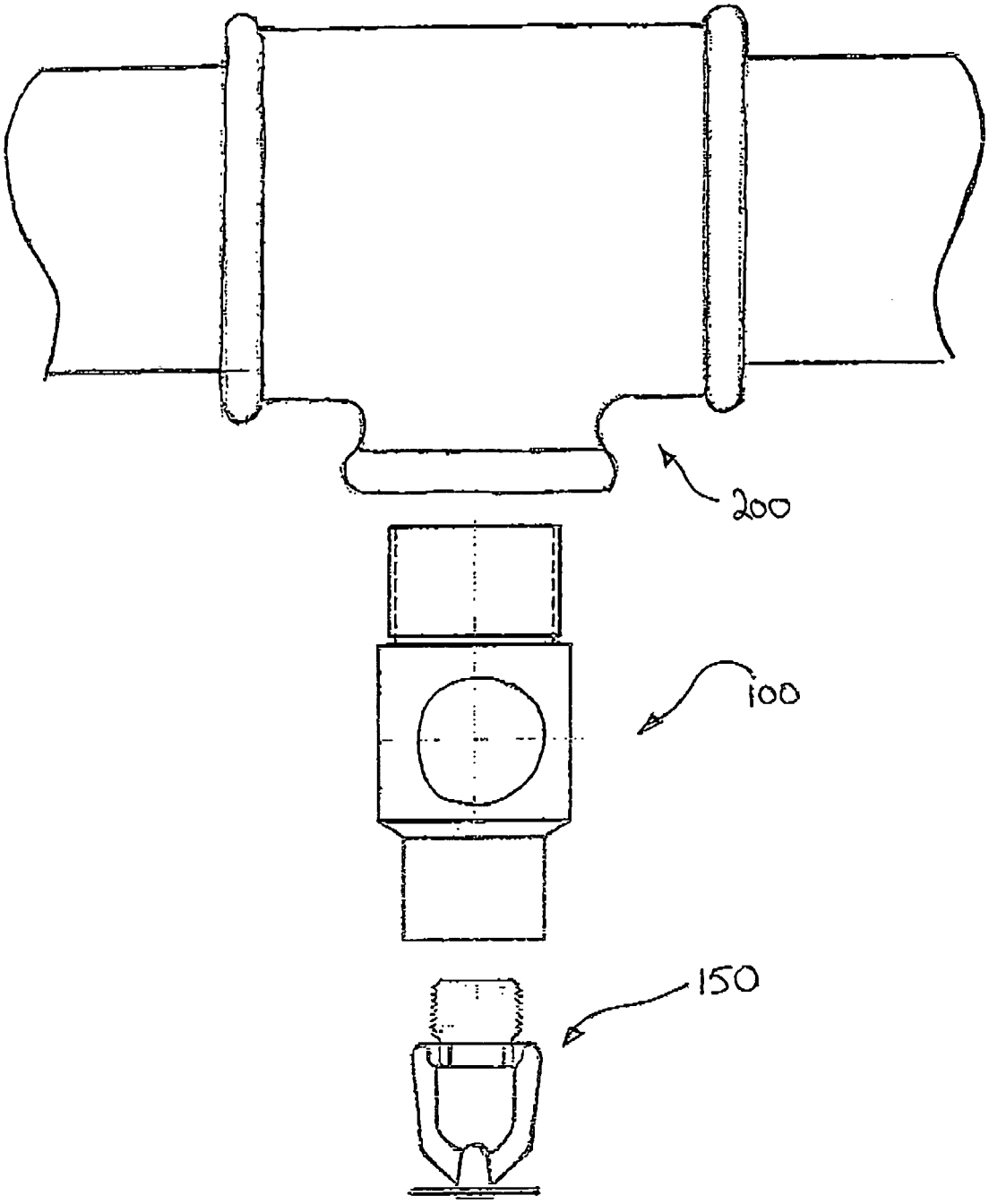
FIG. 3*a* is a schematic, exploded view of an inventive system consisting of the submerged unit, an open sprinkler, and a connection to an automatic fire sprinkler water system.

FIG. 3*a* is a schematic, exploded view of an inventive system consisting of submerged unit 100, an open sprinkler 150, and a standard connection 200 to an automatic fire sprinkler water system.

Figure 3B:
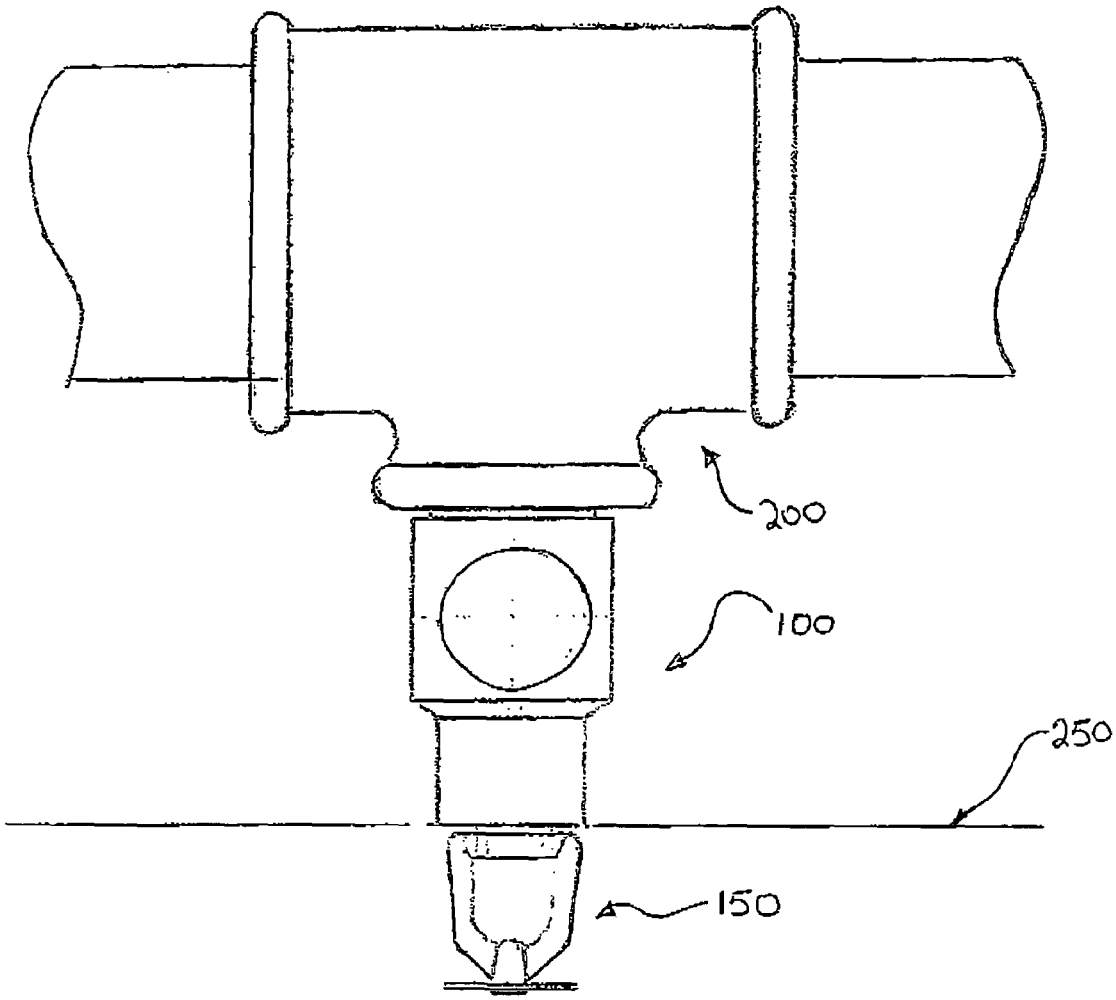
FIG. 3*b* is a schematic side view of the system of FIG. 3*a*, in which the submerged unit is concealed within a ceiling, and the open sprinkler protrudes therefrom.

FIG. 3*b* is a schematic side view of the system of FIG. 3*a*, in which submerged unit 100 is concealed within a ceiling 250. Submerged unit 100 is connected, at a first end, to connection 200 within ceiling 250, and at a second end, to open sprinkler 150, which protrudes from ceiling 250.

It should be stressed that the sprinkler of the present invention is well-protected against malicious and/or accidental activation, since damages caused to the outer unit are not followed by discharge of water from the sprinkler on the merchandise in the protected area. Moreover, since the pipes are always water-charged, there is no delay in the water discharge in the event of a fire. Thus, in addition to being efficient, simple to install and maintain, and inexpensive, the present invention greatly reduces the risk of water damage due to undesirable activation of the sprinkler system, without compromising the response time to an actual fire.

As used herein in the specification and in the claims section that follows, the terms "outer unit" and "discharge unit", are meant to include, but are not limited to, an open sprinkler.

As used herein in the specification and in the claims section that follows, the term "ceiling", used in regard to the thermally sensitive element and the like, is meant to include flooring and/or walls.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. An automatic fire sprinkler device for fluidly connecting to a water system of an automatic fire sprinkler, the device comprising:

(a) a housing having an inlet for fluidly connecting with the water system, and an outlet;

(b) a plug, operatively associated with said housing, said plug having a stand-by position and an activated position, wherein the device is designed and configured such that in said stand-by position, said plug is positioned to obstruct a flow of said water from the water system, and such that in said activated position, said plug is positioned to allow said flow of water to flow from the water system to a discharge unit;

(c) a thermally sensitive element, responsive to a predetermined temperature and operatively connected to said plug, said thermally sensitive element for triggering said plug into said activated position when a temperature of an environment reaches said pre-determined temperature, so as to allow said flow of said water; and (d) a hinge mechanism, associated with said plug, said hinge mechanism for enabling said plug to move from said stand-by position to said activated position.

2. An automatic fire sprinkler device for fluidly connecting to a water system of an automatic fire sprinkler, the device comprising:

(a) a housing having an inlet for fluidly connecting with the water system, and an outlet;

(b) a plug, operatively associated with said housing, said plug having a stand-by position and an activated position;

(c) a thermally sensitive element, responsive to a predetermined temperature and operatively connected to said plug, said thermally sensitive element for triggering said plug into said activated position when a temperature of an environment reaches said pre-determined temperature, so as to allow said flow of said water; and (d) a discharge unit, fluidly connected with said outlet, said discharge unit having a deflector for dispersing water within a water coverage area, wherein the device is designed and configured such that in said stand-by position, said plug is positioned to obstruct a flow of said water from the water system, and such that in said activated position, said plug is positioned to allow said flow of water to flow from the water system to said discharge unit, and wherein, in said stand-by position, said discharge unit is configured to be physically removed from said plug and said thermally sensitive element, and wherein said discharge unit is configured so as to maintain a stationary position with respect to said outlet when said plug moves from said stand-by position to said activated position.

3. The automatic fire sprinkler device of claim 2, wherein said discharge unit includes an open sprinkler.

4. The automatic fire sprinkler device of claim 2, wherein said discharge unit is an open sprinkler.

5. The automatic fire sprinkler device of claim 2, wherein said outlet has a connecting element for connecting between said outlet and said discharge unit.

6. The automatic fire sprinkler device of claim 5, wherein said connecting element includes a threaded end for attaching to said discharge unit.

7. The automatic fire sprinkler device of claim 2, wherein said discharge unit is configured with respect to said housing, said plug, and said thermally sensitive element, for being disposed, in said stand-by position, to protrude from said ceiling, towards said water coverage area.

8. The automatic fire sprinkler device of claim 2, wherein said thermally sensitive element includes a glass component designed to disintegrate at said pre-determined temperature.

9. The automatic fire sprinkler device of claim 8, wherein said thermally sensitive element further includes an expansive material disposed in proximity to said glass component, said expansive material designed to expand so as to break said glass component at said pre-determined temperature.

10. The automatic fire sprinkler device of claim 2, wherein said thermally sensitive element includes a metal component designed to disintegrate at said pre-determined temperature.

11. The automatic fire sprinkler device of claim 2, further comprising:

(d) a hinge mechanism, associated with said plug, said hinge mechanism configured for enabling said plug to move from said stand-by position to said activated position.

12. The automatic fire sprinkler device of claim 2, wherein said thermally sensitive element is for directly triggering said plug.

13. A method of averting erroneous activation of an automatic fire sprinkler, the method comprising the steps of:

(a) providing a device including:

(i) a housing having an inlet for fluidly connecting with the water system, and an outlet;

(ii) a plug, operatively associated with said housing, said plug having a stand-by position and an activated position;

(iii) a thermally sensitive element, responsive to a pre-determined temperature and operatively connected to said plug, said thermally sensitive element for triggering said plug into said activated position when a temperature of an environment reaches said pre-determined temperature, so as to allow said flow of said water; and (iv) a discharge unit having a deflector for dispersing water within a water coverage area, wherein the device is designed and configured such that in said stand-by position, said plug is positioned to obstruct a flow of said water from the water system, and such that in said activated position, said plug is positioned to allow said flow of water to flow from the water system to said discharge unit;

(b) concealing said thermally sensitive element within a ceiling in proximity to said water coverage area, and (c) fluidly connecting said discharge unit to said outlet, such that in said stand-by position, said discharge unit protrudes from said ceiling, towards said water coverage area.

14. The method of claim 13, wherein said discharge unit is structurally separate and removed from said housing and said plug.

15. The method of claim 13, wherein said discharge unit includes an open sprinkler.

16. The method of claim 13, wherein said discharge unit is an open sprinkler.

17. The method of claim 13, wherein said outlet has a threaded end, and wherein said connecting of said discharge unit to said outlet is performed by means of said threaded end.

18. The method of claim 13, wherein said device further includes:

(v) a hinge mechanism, associated with said plug, said hinge mechanism configured for enabling said plug to move from said stand-by position to said activated position.

* * * * *